United States Patent [19]

Eisenblätter

[11] Patent Number: 4,679,360

[45] Date of Patent: Jul. 14, 1987

[54] LAMELLAR END GRINDING WHEEL

[76] Inventor: Gerd Eisenblätter, Jägerweg 10, 8192 Geretsried 2, Fed. Rep. of Germany

[21] Appl. No.: 865,973

[22] Filed: May 22, 1986

[30] Foreign Application Priority Data

Nov. 22, 1985 [DE] Fed. Rep. of Germany ..... 3541347

[51] Int. Cl.[4] ..... B24D 13/14

[52] U.S. Cl. ..... 51/337; 51/334; 15/230.16; 15/230.17; 15/230.19

[58] Field of Search ..... 51/330, 331, 332, 334, 51/336, 337, 358, 364, 376, 388; 15/230.16, 230.17, 230.19

[56] References Cited

U.S. PATENT DOCUMENTS 1,445,295 2/1923 Cangen ..... 51/364
1,869,564 8/1932 Johnston ..... 15/230.18
3,616,581 11/1971 Johnson et al. ..... 51/337
4,133,146 1/1979 DeCola ..... 51/336

FOREIGN PATENT DOCUMENTS 2359483 6/1975 Fed. Rep. of Germany ..... 51/358
1370846 10/1974 United Kingdom ..... 51/334

*Primary Examiner*—Robert P. Olszewski
*Attorney, Agent, or Firm*—Fleit, Jacobson, Cohn & Price

[57] ABSTRACT

A back plate for a lamellar end grinding wheel is described, in which grinding flaps overlap one another in tile-like manner along the circumferential zone of a circular disc-like back plate. The arrangement is characterized in that the back plate is constructed as a metal plate, to which is fixed a supporting plate and that the grinding flaps are secured between these two plates.

19 Claims, 9 Drawing Figures

LAMELLAR END GRINDING WHEEL

BACKGROUND OF THE INVENTION

The invention relates to a lamellar or fan-type end grinding wheel in which abrasive or grinding flaps overlapping one another in tile-like manner and fixed are positioned along the circumferential zone of a circular disc-shaped, flexible base or back plate and project through radial slots in the circumferential zone.

Lamellar end grinding wheels can be used in different ways, but are preferably used in angle grinders. However, such lamellar end grinding wheels can also be used in drilling machines or similar grinding equipment.

A preferred field of use of lamellar end grinding wheels is the smoothing and cleaning of welding seams and spots. In this connection, such lamellar end grinding wheels can also be used for roughing and polishing, without it being necessary to use different wheels or grain sizes. Thus, with the aid of a single tool, it is possible to obtain a particularly good surface quality. However, lamellar end grinding wheels of the present type are also suitable for other operations such as deburring, bevelling, rust removal or removing old paint. It is also possible to work the most varied materials, such as steel, refined steel, nonferrous metals, aluminium, rigid plastics, artificial stone, rocks, wood or fillers.

A lamellar end grinding wheel of the aforementioned type is known from U.S. Pat. No. 3,616,581. This grinding wheel comprises a completely rigid metallic inner wheel or disc with an opening in the centre, around which is concentrically placed a ring with an internal thread for screwing onto a spindle fitted to a grinding tool. The inner wheel is embedded at its edge in a circular ring-shaped outer plastic wheel, which has the radial slots for receiving the grinding flaps. A completely rigid mounting flange is necessary for operating this grinding wheel and is mounted on the tool spindle upstream of the grinding wheel. The grinding wheel equipped with the grinding flaps and partly projecting out of the slots on the workpiece-remote side is subsequently screwed onto the spindle, the circumferential edge of the inner wheel being braced against a rubber-lined, raised edge on the outer circumference of the mounting flange. The intermediate flap portions are fixed in the initial region of the slots. Thus, in the outer region of the grinding wheel the flaps are not fixed.

This lamellar end grinding wheel suffers from the disadvantage that it can only be used with an individually adapted mounting flange and that a locking of the grinding flaps can only take place in conjunction with a grinding tool, whose spindle thread must correspond to the grinding wheel thread. It is also disadvantageous that the grinding flaps are only held at one end, so that the reliability of the fixing is dependent on the care exercised by the operator responsible for fixing the grinding wheel. It is also disadvantageous that the rubber lining of the mounting flange is subject to wear, so that with increasing use the fixing effect decreases. In order to produce the necessary high contact pressure, which is vital for maintaining the grinding flaps over a relatively small pressure surface, the inner wheel and the mounting flange must have a rigid construction, so that the inner region of the grinding wheel must be rigid and does not have the flexibility desired during use. It is also disadvantageous that the operator must take care when mounting a grinding wheel on the mounting flange that the projecting ends of the grinding flaps are uniformly arranged and aligned in the clamping zone to avoid the application of individual flaps, thereby no longer ensuring the clamping of other flaps.

The problem of the present invention is to provide a lamellar end grinding wheel of the aforementioned type, in which the clamping of the grinding flaps takes place directly, i.e. independently of a grinding tool.

SUMMARY OF THE INVENTION

This problem is solved in that the back plate is constructed as a sheet metal disc and that on the side of the back plate remote from the working surface is arranged a supporting plate, that the supporting plate is fixed, at least on the outer circumference to the back plate and that the rear ends of the grinding flaps are fixed between the back plate and the supporting plate.

This leads to a disc or wheel arrangement, which is not only characterized by an extremely high dimensional stability and squeezing stability, but also offers the possibility of having the grinding flaps anchored in a simple and operationally reliable manner by the manufacture by the back plate and the supporting plate being pressed against one another following firm interconnection in the circumferential region.

According to another preferred embodiment of the invention the side of the back plate and/or supporting plate associated with the rear ends of the grinding flaps have projecting punching or stamping points for engaging in the flaps. As a result the grinding flaps are firmly and reliably anchored. This further development of the inventive concept is made particularly operationally reliable by the stamping points being constructed as triangular barbs.

In principle, a single stamping point or a single barb for each grinding flap would suffice to ensure that the particular flap was very durably fixed between the back plate and the supporting plate. It is naturally also possible to provide two barbs per grinding flap, or a plurality of barbs can be formed over the entire plate surface in uniformly distributed manner. If the grinding flaps are inserted in the slot and the supporting plate is pressed onto the back plate, the tips of the barbs are embedded in the material of the pressed home grinding flaps. In operation the forces acting on the grinding flaps always have the tendency to press the inventive barbs more deeply into the flap material. Thus, there is a further improvement to the fixing of the grinding flaps between the two plates.

If during the operation of the inventive lamellar end grinding wheel excessive stressing leads to a movement of the grinding flaps which would lead to the removal thereof from the back plate, the stamping points or barbs press even more firmly into the grinding flap material, which increases the anchoring effect. A particularly simple construction of the barbs for achieving the aforementioned advantages is obtained through their being formed from a triangular sheet metal part, which are cut from the material of the back or supporting plate except for one side on which they are bent out of the plate plane.

It is preferably provided that the supporting plate has radially directed fingers, which slope in the circumferential direction. This measure has the advantage that the individual flaps can be pressed along the entire slot by the spring tension of the fingers. A further advantage is that the fingers can be made in a simple manner, if the supporting plate is provided with radial slots and the intermediate portions are turned against the supporting plate plane.

The firm connection of the supporting plate and the back plate is preferably achieved in that the circumferential edge of the back plate is bent over towards its side remote from its working surface to form a hook-like circumferential flange in radial section, the supporting plate being fixed under the bent over edge. Thus, the grinding wheel acquires additional rigidity.

The preferred material for the supporting plate is sheet metal, particularly light sheet metal.

An advantageous further development of the lamellar end grinding wheel comprises the rear ends of the grinding flaps being thickened. These thickened portions further help to ensure that the grinding flaps will not slide out of their slots despite the clamping effect during use if particularly high tensile forces occur.

The thickened portion preferably comprises a mounted clip extending substantially over the entire width of the particular grinding flap. These clips can e.g. be fitted by bonding or rivetting to the grinding flap. The clip comprises a slotted, tubular part, which is mounted on the end of the grinding flap and can be fixed by bonding or rivetting.

Alternatively, the thickened portion can be produced in a simple manner in that rivets are fitted along the rear end of the particular grinding flap. A particularly effective and easily manufacturable thickened portion is also obtained by applying an adhesive bead to the grinding flap.

In the case where the supporting plate is provided with fingers, it is preferably provided that the grinding flaps have at least one slot-like recess in their rear regions pass through the slots. This has the advantage that the finger or at least a portion thereof can be passed through, so that the grinding flap is hooked in. The recess can be an opening in the grinding flap and which is surrounded by the material of the latter. Alternatively or additionally thereto, it can be advantageous for the rear regions of the grinding flaps to be provided with projecting arms in which engage the end faces of the slots made in the supporting plate and which extend over and beyond the longitudinal extension of the associated slot. This supports the grinding flap between the back plate and the supporting plate and also hangs the flap in the finger.

It is advantageous to locate a flat, arcuate strip between the back plate and the supporting plate and said strip is passed through the recesses of several juxtaposed grinding flaps. Thus, on said strip are hung several grinding flaps, which are additional secured between the supporting and back plates.

As a result of these measures, the grinding wheel according to the invention can be manufactured with simple means and in a short time. Nevertheless a grinding wheel is obtained representing a complete, independent commercial product, which can be individually mounted on a grinding tool. When reequipping the grinding tool, there is no need for the operator to ensure that he carries out the clamping of the grinding flaps in an operationally reliable manner. The grinding wheel arrangement according to the invention is characterized by being easy to manufacture, operating in a particularly reliable manner and enabling a grinding tool to be reequipped without difficulty.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
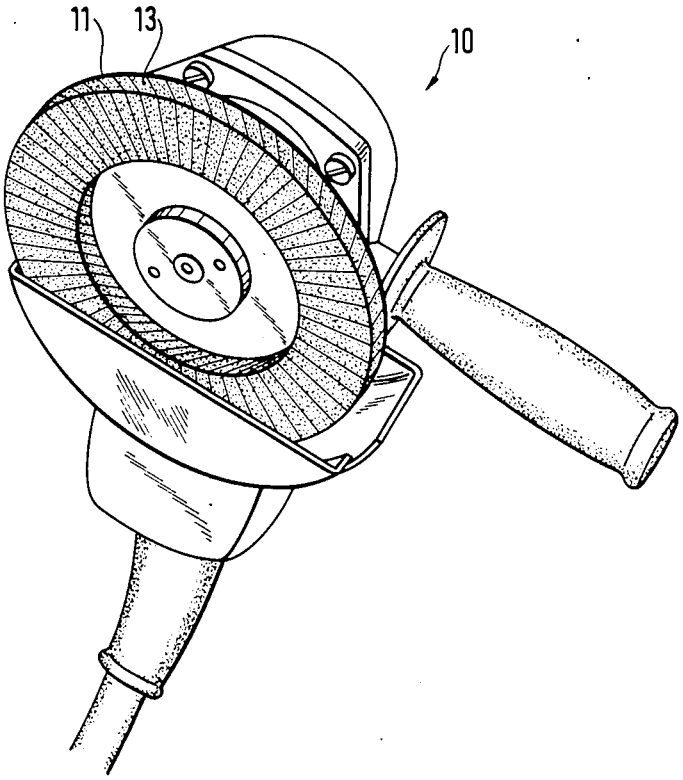
FIG. 1 A perspective view of an angle grinder with a lamellar end grinding wheel according to the invention.

FIG. 1 is a perspective view of an angle grinder 10 equipped with a lamellar end grinding wheel. The grinding wheel is constructed in such a way that grinding flaps 13, superimposed in tile-like or flake-like manner are fitted to a back or base plate 11 made from metal and preferably from an aluminium alloy. The grinding flaps 13 are fixed to the back plate 11 in the manner to be described hereinafter.

Figure 2:
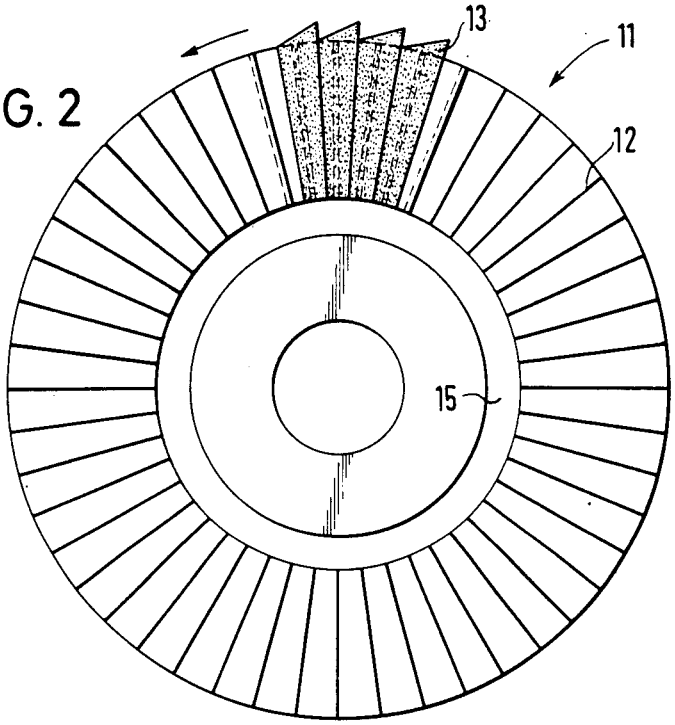
FIG. 2 A diagrammatic view of a back plate, which is partly equipping with grinding flaps.

Firstly radial slots 12 are made in the outer circumferential area of the basically circular disc-shaped back plate 11, as is diagrammatically illustrated in FIG. 2. This leads to the formation of through-openings, into which can be inserted the rear ends of the grinding flaps 13.

For stiffening purposes and as will be described hereinafter for increasing the contact surface pressure, the back plate 11 can be provided with a reinforcing seam 15, which particularly favourably acts on the dimensional stability of the back plate 11 in the case of a high operating load, i.e. squeezing.

Figure 3:
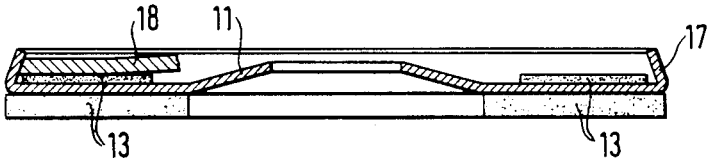
FIG. 3 A section through the back plate shown in FIG. 1.

FIG. 3 illustrates in a section through the back plate according to FIG. 1 the grinding flaps 13 in their completely fixed position to the back plate 11. According to FIG. 3, back plate 11 is provided on its outer circumference with a circumferential flange 17, which is bent over in hook-like manner with respect to the main plane of back plate 11. This circumferential flange can e.g. be beaded. According to FIG. 3, the outer circumferential edge of the back plate 11 is bent over by more than 90° in order to form the circumferential flange. The latter gives the back plate 11 an extremely high torsional stiffness, which has a favourable effect on the dimensional stability in operation. The slightly inwardly inverted over edges of the circumferential flange 17 form a circular opening. As the diameter of the circumferential flange 17 increases conically towards the main plane of back plate 11, the space surrounded by circumferential flange 17 increases from the circumferential edge of said flange to the main plane of back plate 11. It is therefore possible to fix a circular ring-like supporting plate 18 behind the circumferential edge of the circumferential flange 17. Such a ring ensures a fixing of the rear flap portions.

The rear region of back plate 11, i.e. the region remote from the grinding flaps 13 is covered by the supporting plate 18. The latter is only purely diagrammatically shown in the left-hand region in FIG. 3. The supporting plate can extend over the entire circular disc surface of the back plate 11, naturally with the exception of the always necessary reception bore. If the supporting plate 18 has a construction and in particular a strength and rigidity corresponding to the corresponding characteristics of back plate 11, an extremely stable and rigid construction is obtained. It is also possible to use supporting plate 18 for bending over and simultaneously fixing the rear ends of the grinding flaps 13.

It is generally sufficient if the supporting plate 18 is firmly connected to the back plate 11 in the outer circumferential region, e.g. by welding, bonding, rivetting or beading. It is also possible to provide additional fixing points on the surface of the two plates, if this should be desired with a view to obtaining greater strength, stability and rigidity.

Both supporting plate 18 and back plate 11 can be made from light metal giving an extremely lightweight and at the same time elastic and very stable construction. This construction of the object of the invention is also largely corrossion-resistant and as a waste product is also very advantageous from the environmental standpoint.

Figure 4:
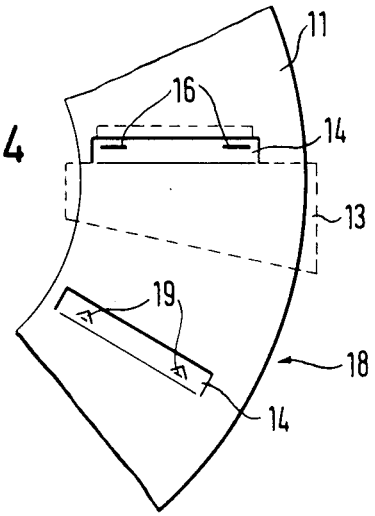
FIG. 4 A diagrammatic partial view of a supporting plate for illustrating the stamping points for fixing the grinding flaps.

As is diagrammatically shown in FIG. 4, the fixing of the grinding flaps 13 can be further improved in that fingers 14 with stamping points 16 are formed on supporting plate 18. These stamping points 16 can be small protuberances, which are arranged on that side of the fingers 14 facing the grinding flaps 13. If the supporting plate 18 and back plate 11 are compressed for anchoring the grinding flaps, the raised stamping points 16 are embedded in the material of the flaps 13 and consequently form additional anchoring points.

In place of the stamping points 16 illustrated in FIG. 4, e.g. the edges of the fingers 14 could be slightly bent and made sharp-edged in the direction of the grinding flaps 13, so that on pressing together the two disc or wheels the edge regions are embedded into the material of the flaps 13 to such an extent that a reliable anchoring of flaps 13 between back plate 11 and supporting plate 18 is ensured.

The lower region of FIG. 4 illustrates diagrammatically an alternative embodiment of the supporting plate 18. Two barbs 19 are formed on the finger 14 shown at the bottom and on pressing together the back and supporting plates, when the fingers 14 are pressed into the body of the supporting plate 18, their tips are embedded in the material of the grinding flaps 13.

Barbs 19 are produced in such a way that initially an angular slot is made in a finger 14. The region of the finger 14 enclosed by the angular slot is then bent out of the finger plane counter to the direction in which the finger is exhibited opposite to the back plate. A grinding flap 13 can be readily inserted in the slot, without being significantly hindered by the barbs bent out towards the grinding flap. Only when the fingers 14 are firmly pressed onto the grinding flaps 13 do the barbs 19 embed in the material of the flaps and thereby form an extremely reliable fixing of the flaps 13 between back plate 11 and supporting plate 18.

For the easier understanding of FIG. 4, in the example of the upper finger 14, only one grinding flap 13 is indicated in broken line form for illustrating the association of supporting plate 18 and fingers 14 with respect to the grinding flaps. The fingers 14 are bent out of the drawing plane in the direction of the back plate and flaps. They are braced against the grinding flaps 13 and consequently ensure that they cannot be drawn out of the complete grinding wheel.

Figure 5:
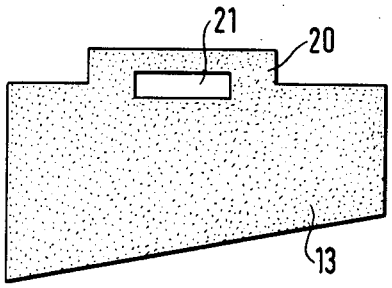
FIGS. 5 to 7 Diagrammatic embodiments of the grinding flaps.
Figure 6:
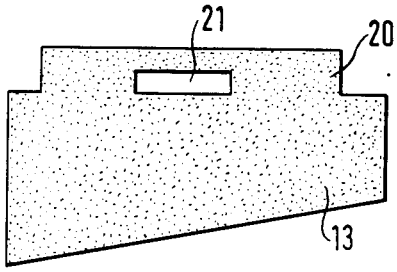
Figure 7:
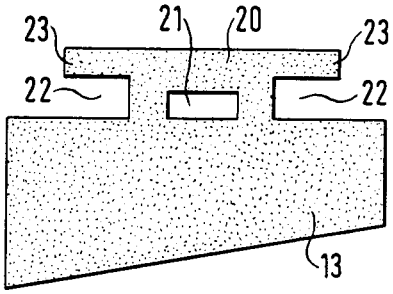

FIGS. 5, 6 and 7 diagrammatically show an advantageous further development of the grinding flap 13 provided in its rear edge region 20, for insertion in one of the radial slots in the back plate, with a slot-like recess 21 (FIGS. 5 and 6) or with several such recesses 21 (FIG. 7). In the case of a grinding wheel equipped with grinding flaps 13 according to FIG. 5, tongues 16 are placed through the recesses 21 and in this case need not have any stamping or barb. Thus, the grinding flaps 13 are caught by the recesses 21 and prevented from drawing out.

Alternatively, fingers 16 can be longitudinally subdivided into several, not shown finger portions in order to secure the associated grinding flaps 13 in a combination of clamping and back-engaging. Fingers 14 are subdivided into three portions for the use of grinding flaps, e.g. according to FIG. 6. The central finger portion is passed through the recess 21 of the particular grinding flap 13, whilst the two outer finger portions press onto the laterally adjacent flap portions.

FIG. 7 shows in exemplified manner a grinding flap 13 which, apart from the recess 21, has lateral recesses 22, so that projecting flap arms 23 are formed. The end face of the slots provided on the back plate engage in recesses 22. The projecting arms 23 extend over the longitudinal extension of a radial slot in the back plate and by bearing on the latter provide an additional securing effect.

Figure 8:
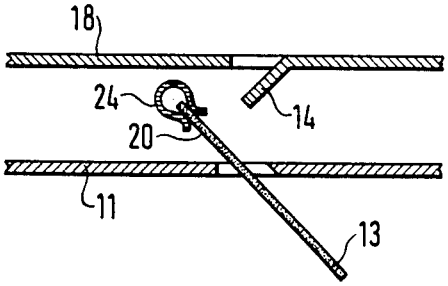
FIG. 8 Diagrammatically a cross-section along the circumferential line through a lamellar end grinding wheel.
Figure 9:
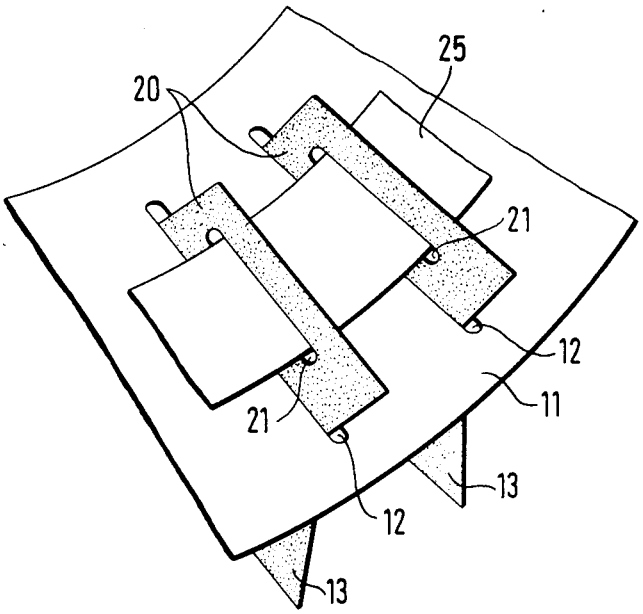
FIG. 9 A Diagramatic view of an alternative lamellar and grinding wheel.

A further alternative of a lamellar end grinding wheel as shown in FIG. 9 comprises arranging a flat, arcuate strip 25 between the back plate and supporting plate and this is passed through the recesses 21 of several juxtaposed grinding flaps 13. FIG. 8 shows a further example of a lamellar end grinding wheel in a purely diagrammatic cross-section along the circumferential line. The rear edge portion 20 of the grinding flaps 13 is provided with a thickened portion which, in the present case is a clip, which substantially extends over the entire width of the grinding flap. This clip can e.g. be fitted by bonding or rivetting to the flap 13. FIG. 8 clearly does not illustrate the final state of the lamellar end grinding wheel when the back plate 11 and supporting plate 18 are firmly interconnected and pressed against one another, leading to the clamping of grinding flap 13. In this state, finger 14 presses against portion 20, the end face of finger 14 being embedded in the material of grinding flap 13.

What is claimed is:

1. Lamellar end grinding wheel comprising a circular disc-shaped flexible back plate, grinding flaps arranged along a circumferential zone of said back plate so as to overlap one another in tile-like manner and being fixed there, said grinding flaps being passed through radial slots formed in said circumferential zone, said back plate being constructed as a sheet metal plate, a supporting plate arranged on the side of said back plate remote from a working surface, said supporting plate being firmly connected to said back plate at least on the outer circumference of said back plate, rear ends of said grinding flaps being fixed between said back plate and said supporting plate, and a circumferential edge of said back plate being bent over towards a side remote from said working surface to form a hook-like circumferential flange in radial section and said supporting plate being fixed under said hook-like circumferential flange.

2. Lamellar end grinding wheel according to claim 1, wherein at least one of a side of said back plate and said supporting plate associated with said rear ends of said grinding flaps are provided with projecting stamping points for engaging in said grinding flaps.

3. Lamellar end grinding wheel according to claim 2, wherein said stamping points are constructed as triangular barbs.

4. Lamellar end grinding wheel according to claim 1, wherein said suporting plate has radial fingers, which are arranged in sloping manner in a circumferential direction.

5. Lamellar end grinding wheel according to claim 4, wherein said grinding flaps have at least one slot-like recess in their rear regions which are passed through said radial slots.

6. Lamellar end grinding wheel according to claim 5, wherein said rear region of said grinding flaps is provided with projecting arms, said projecting arms engaging end faces of associated slots and extend over and beyond the longitudinal extension of the associated slot.

7. Lamellar end grinding wheel according to claim 5, wherein a flat, arcuate strip is located between said back plate and said supporting plate and is passed through recesses defined by several juxtaposed grinding flaps.

8. Lamellar end grinding wheel according to claim 1, wherein said supporting plate is made from sheet metal.

9. Lamellar end grinding wheel according to claim 1, wherein each of said rear ends of said grinding flaps is provided with a thickened portion.

10. Lamellar end grinding wheel according to claim 9, wherein said thickened portion comprises a mounted clip extending substantially over the entire width of a particular grinding flap.

11. Lamellar end grinding wheel according to claim 9, wherein said thickened portion is formed by rivets, which are fitted along the rear end of a particular grinding flap.

12. Lamellar end grinding wheel according to claim 9, wherein said thickened portion is formed by an adhesive bead, which is applied to said grinding flaps.

13. Lamellar end grinding wheel comprising a circular disc-shaped flexible back plate, grinding flaps arranged along a circumferential zone of said back plate so as to overlap one another in tile-like manner and being fixed there, said grinding flaps being passed through radial slots formed in said circumferential zone, a supporting plate clamping said grinding flaps on a back side of said back plate, and a circumferential edge of said back plate bent over towards a side remote from a working surface to form a hook-like circumferential flange in radial section and said supporting plate being fixed under said hook-like circumferential flange.

14. Lamellar end grinding wheel according to claim 13, wherein said supporting plate and said back plate are made from sheet metal.

15. Lamellar end grinding wheel according to claim 13, wherein said back plate and said supporting plate are welded together.

16. Lamellar end grinding wheel according to claim 13, wherein said back plate and said supporting plate are connected toward each other by spot welding.

17. Lamellar end grinding wheel according to claim 13, wherein said back plate and said supporting plate are flanged to each other.

18. Lamellar end grinding wheel according to claim 13, wherein said back plate and said supporting plate are bonded to each other.

19. Lamellar end grinding wheel according to claim 13, wherein said back plate and said supporting plate are connected to each other by riveting.

* * * * *